US007810548B2

(12) United States Patent
Nishina

(10) Patent No.: US 7,810,548 B2
(45) Date of Patent: Oct. 12, 2010

(54) METHOD OF REMOVING EXCESS METAL FROM CASTING WITH PRESS, AND CUTTER USED THEREFORE

(75) Inventor: Katsuya Nishina, Mohka (JP)

(73) Assignee: Mohka Mfg. Co., Ltd., Mohka-shi, Tochigi-ken (JP)

( * ) Notice: Subject to any disclaimer, the term of this patent is extended or adjusted under 35 U.S.C. 154(b) by 0 days.

(21) Appl. No.: 11/606,059

(22) Filed: Nov. 30, 2006

(65) Prior Publication Data

US 2007/0074840 A1 Apr. 5, 2007

(51) Int. Cl.
*B22D 31/00* (2006.01)

(52) U.S. Cl. ..... 164/262

(58) Field of Classification Search ..... 164/70.1, 164/262

See application file for complete search history.

(56) References Cited

U.S. PATENT DOCUMENTS 2,574,953 A * 11/1951 Bess et al. ..... 407/13

4,175,497 A * 11/1979 Lund ..... 112/80.6

FOREIGN PATENT DOCUMENTS

| | | | |
|---|---|---|---|
| JP | 9-19724 | * | 1/1997 |
| JP | 09-019724 | | 1/1997 |
| JP | 11-197820 | * | 7/1999 |
| JP | 2004-17127 | | 1/2004 |

* cited by examiner

*Primary Examiner*—Kevin P Kerns
(74) *Attorney, Agent, or Firm*—Jacobson Holman PLLC

(57) ABSTRACT

A set of dies are composed in order to remove excess metal from a casting with a press. A method of removing the excess metal from the casting includes the steps of: attaching a cutter to one of the stationary die side or the movable die side; setting a work on the other side; and punching excess metal of the work into a recess shape by one punching motion of the movable die with a plurality of blades from the first blade, which is smaller, to the final blade, which is larger and protruded, when the excess metal of the work is removed by a punching motion of the movable die conducted on the stationary die.

3 Claims, 7 Drawing Sheets

METHOD OF REMOVING EXCESS METAL FROM CASTING WITH PRESS, AND CUTTER USED THEREFORE

TECHNICAL FIELD

The present invention relates to a method of removing excess metal from a casting with a press and also relates to a cutter used therefore.

BACKGROUND ART

A casting has unnecessary portions to be removed such as a pouring gate, a weir, burr and so forth. These unnecessary portions are removed in the finishing process. In order to remove these unnecessary portions, it is conventional to conduct punching on these portions with a hydraulic press or mechanical press to which a cutting blade is attached. Concerning the excess metal of a casting, there are two types. One is the excess metal of a casting which is unavoidably generated in the process of casting, and the other is the excess metal of a casting which is intentionally provided for accomplishing a predetermined design object. Therefore, the latter can not be necessarily defined as an unnecessary portion of a casting. However, in the present invention, irrespective of the cause of the generation of the excess metal of a casting, portions, which must be removed from the casting after the completion of the casting process, are defined as the excess metal of the casting. In general, the larger the volumes of the excess metal portions are, the more difficult it becomes to remove the excess metal portions from the casting.

Concerning the prior art, the object of which is to remove the excess metal from a casting, for example, JP-A-2004-17127 discloses a deburring apparatus and burr blanking tool used therefore. According to the invention disclosed in JP-A-2004-17127, an annular burr portion generated in the peripheral edge of an insulator cap, which is a casting manufactured by a split mold, is removed by means of punching. In this case, an annular punching blade is used which is composed of high and low blades, the heights of the blade ends are different from each other in the punching direction. The high blades are separate from each other at predetermined intervals, and the low blades are arranged between the high blades. Therefore, at first, a work is punched out by the high blades in such a manner that the punched portions are formed like dotted lines. Successively, the low blades punch out portions between the dotted lines. Due to the foregoing, it is possible to reduce the maximum shearing load necessary for annular cutting.

According to the above invention in which the burr is cut off by the high and low blades, the following effects are expected. Since the entire circumference is not cut at the same time, as compared with a conventional case in which cutting is conducted with a conventional annular cutting blade, the maximum cutting load can be reduced to about 30%. However, in the above invention, the prior cutting is conducted with the high blades, and the successive cutting is conducted with the low blades. Therefore, any portion of the burr is subjected to the cutting action only once. Accordingly, this method is effectively used for removing the burr, the volume of which is relatively small. However, this method is not effectively used for removing an excess metal portion of a casting such as a portion of the casting which is provided for the design object, the volume of which is relatively large.

JP-A-11-197820 discloses a method of removing an unnecessary portion from a casting. According to this invention, similar blade faces, which are arranged in an upper and a lower blade, are composed in such a manner that the similar blade faces are formed into shapes similar to the cutting portion of a casting. When the upper and the lower blades slide to and bite into a portion to be cut, the unnecessary portion of the casting is cut off. Since the upper and the lower blade have similar blade faces, the upper and the lower blade are fitted to the outer shape of the cutting portion. Accordingly, the upper and the lower blade smoothly bite into the cutting portion without fluctuation. Since the upper and the lower blade have shoulder blades at the respective blade ends, no cracks are caused in the cutting portion. Therefore, it is expected that the cutting can be beautifully conducted. In this case, the similar blade faces provided in the upper and the lower blade are similar to the cutting portion of the casting. Therefore, it can be considered that cutting is conducted to be a shape which is similar to the cutting portion. Accordingly, it is estimated that this work is similar to a deburring work. Therefore, it is unknown whether or not the capacity of removing an unnecessary portion from a casting, the volume of which is relatively large, is sufficiently large.

On the other hand, the main object of the present invention is to remove an excess metal portion from a casting in the process of working the casting, that is, the main object of the present invention is to remove an excess metal portion from a casting which is necessary from the viewpoint of designing the casting. For example, in the bracket of the disk brake for automobile use shown in FIGS. 11 and 12, the casting 1 requires the brake pad guides 4 in which both end pieces 3, 3 of the brake pad 2 are arranged. It is an object of the present invention to form the brake pad guides 4 by executing the method of removing the excess metal from the casting. The portion 5, in which the brake pad guide 4 is formed, can not be formed into a recess shape because of the restriction of the casting mold. Therefore, the portion 5 must be left as the excess metal of the casting 1 having the leaves shown in FIG. 11. In this connection, reference numeral 6 is a caliper. In order to form the brake pad guide 4, it is necessary to form a recess portion in the excess metal portion 5. Compared with the conventional method in which only one side of a protruding root portion is cut off, it is necessary to cut off three sides. Therefore, the cutting resistance is three times as high as that of the conventional method. Actually, a higher intensity of the cutting force is required. Accordingly, an excessively heavy load is given to the blade. Therefore, it seems to be difficult that the cutting is conducted by a press. A recess portion such as a brake pad guide can not be formed by means of cutting off but it is common that a recess portion such as a brake pad guide is formed with a machine tool. However, when the machine tool is used, the man-hour is increased and the manufacturing cost is raised. Further, when a new machine tool is used for finishing a casting, an excessive equipment investment is required.

[Patent Document 1] JP-A-2004-17127

[Patent Document 2] JP-A-11-197820

DISCLOSURE OF THE INVENTION

Problems that the Invention is to Solve

The present invention has been accomplished in view of the above circumstances. It is an object of the present invention to provide a method, a device and a cutter used therefore by which the excess metal can be removed from a casting with a press. More particularly, it is an object of the present invention to provide a method, a device and a cutter used therefore by which the excess metal can be punched off from a casting while the punched portion is being formed into a recess shape. It is another object of the present invention to conduct finishing on a casting at low cost.

Means for Solving the Problems

In order to solve the above problems, the present invention provides a method of removing excess metal from a casting with a press comprising the steps of: attaching a cutter to one of a stationary die side or a movable die side which composes a set of dies; setting a work on the other side; and punching the excess metal of the work into a recess shape by one punching motion of the movable die with a cutting means composed of a plurality of blades from a first blade, which is smaller, to a final blade, which is larger and protruded, when the excess metal is removed by a punching motion of the movable die conducted on the stationary die.

It is clear from the above constitution of the present invention that the present invention is to use a press. Since it is possible to use a press in the method of the present invention, it is unnecessary to introduce a new finishing machine. Therefore, the equipment investment can be reduced. A press to be used must include a set of dies composed of a stationary die and a movable die. A cutter is attached to one of the stationary die side or the movable die side, and a work is set on the other of the stationary die side or the movable die side. The structure for setting the work may be the same as that of the conventional device.

According to the present invention, the excess metal of a work is punched into a recess shape so as to remove it. In order to punch the excess metal, a cutting means is used which includes a plurality of blades arranged in a row from the first smaller blade to the final larger protruding blade. It is impossible that punching the excess metal of a work into a recess shape is carried out by only one time of punching motion because an excessively heavy load is given to the blade in the punching motion. Therefore, in order to reduce the load given to the blade, the present invention adopts a method in which the depth and width of punching are gradually extended from a state in which the depth and width of punching are smaller than those in the final state (Refer to FIG. 4.).

For example, in the case where the depth of the recessed excess metal to be punched is 5.7 mm as shown in FIG. 4 and this excess metal is subjected to cutting by the blades of 9 steps, the cutting depth per one step is 0.63 mm. This cutting depth is not an absolute value. For example, according to the result of an experiment made by the present inventors, the maximum cutting depth was 2.0 mm. It is preferable that the minimum cutting depth is not less than 0.3 mm so that the cutting operation can be smoothly conducted. Accordingly, in the present invention, it is preferable that the cutting depth per one step is maintained in the range from 0.3 mm to 2.0 mm. On the other hand, when a machine tool is used for cutting, the cutting depth per one cutting motion is only several per cent millimeter. Therefore, according to the present invention, cutting can be conducted by a high efficiency approximately 10 times as high as the efficiency of the cutting conducted by the machine tool. This cutting depth is one of the effects provided by the present invention. The present invention is characterized in that this cutting depth can be achieved by one stroke motion of a press.

Concerning the cutting means used for the excess metal removing method of the present invention, a cutter is used which comprises a row of blades in which a plurality of blades are arranged step-wise having a change in the form from the first blade, which is smaller than the final shape of the excess metal to be punched, to the final blade, the shape of which is the same as the final shape, wherein the row of blades from the first blade to the final blade are arranged so that the first small blade can be used being ahead of other blades and the other blades can be used in the order of punching motions. However, the structure form of a row of cutting blades composed of a plurality of blades from the first smallest blade to the larger protruding final blade can be freely determined. For example, chips of only points of the blades may be mounted on the base member. On the other hand, as shown in FIG. 1, of course, it is possible to use a cutting means, in which a row of the plurality of blades from the first smaller blade to the larger protruding final blade are directly formed on a base member made of tool steel, at the right and left side edge of a single plate.

A cutter comprises a row of blades in which a plurality of blades are arranged step-wise having a change in the form from the first blade, which is smaller than the final shape of the excess metal to be punched, to the final blade, the shape of which is the same as the final shape. For example, a cutter composed of one plate is formed into the shape shown in FIG. 5. A cutter divided into a right and a left portion is formed into the shape shown in FIG. 6. When the cutter shown in FIG. 6, which is divided into the right and the left portion, is further divided into an upper and a lower portion, the cutter shown in FIGS. 1 to 3 can be provided, that is, the cutter divided into four portions is shown in FIGS. 1 to 3. When the cutter is divided into small portions as described above, only one portion may be replaced in the case where the cutter is damaged, and the maintenance cost can be preferably reduced.

Since the present invention is composed as described above, a load, which is given when punching is conducted by the cutting means including a plurality of blades with a press, is divided into a plurality of steps, and cutting conducted by the first blade to the final blade can be accomplished by one punching motion of the movable die, so that the excess metal of a work can be punched into a recess shape. As described above, according to the excess metal removing method of the present invention, when the cutting depth, which is ten times as deep as that of cutting conducted by a machine tool, is cut in several steps, the cutting depth of several millimeters can be accomplished. Therefore, a recess shape composed of three sides, a hook-shaped recess shape composed of two sides and U-shape can be easily formed by means of punching.

Advantage of the Invention

According to the present invention, the excess metal can be removed from a casting with a press without using a machine tool. Especially, the excess metal of a work can be removed by punching it into various shapes. Therefore, the cost of finishing the casting can be reduced. Further, compared with a method in which the excess metal is removed with a machine tool, the finishing processing can be performed at high speed.

BRIEF DESCRIPTION OF THE DRAWINGS

FIG. 1 is a view showing an example of the apparatus for executing the method of removing excess metal from a casting with a press of the present invention, wherein FIG. 1A is a front view and FIG. 1B is a sectional view taken on line IB-IB in FIG. 1A.

FIG. 2 is a front view showing an example of the cutter used for the method of the present invention.

FIG. 3 is a side view of FIG. 2.

FIG. 4 is a view showing a cutting blade of the cutter shown in FIG. 2 in detail, wherein FIG. 4A is a front view, FIG. 4B is a plan view, FIG. 4C is a side view and FIG. 4D is a schematic illustration showing a protrusion and shape of the blade in each step.

FIG. 5 is a front view showing another example of the cutting blade of a cutter.

FIG. 6 is a front view showing still another example of the cutting blade of a cutter.

FIG. 7 is a schematic illustration showing a state in which a work is set in the excess metal removing method of the present invention.

FIG. 8 is a schematic illustration showing a state in which a work has been set after the state shown in FIG. 7.

FIG. 9 is a plan view showing a state corresponding to the state shown in FIG. 7.

FIG. 10 is a plan view showing a state corresponding to the state shown in FIG. 8.

FIG. 11 is a schematic illustration showing an excess metal portion and a recess portion to be removed from a casting.

FIG. 12 is a schematic illustration showing a state in which a brake pad guide, which is a casting, and other parts are combined with each other.

DESCRIPTION OF REFERENCE NUMERALS

Figure 1:
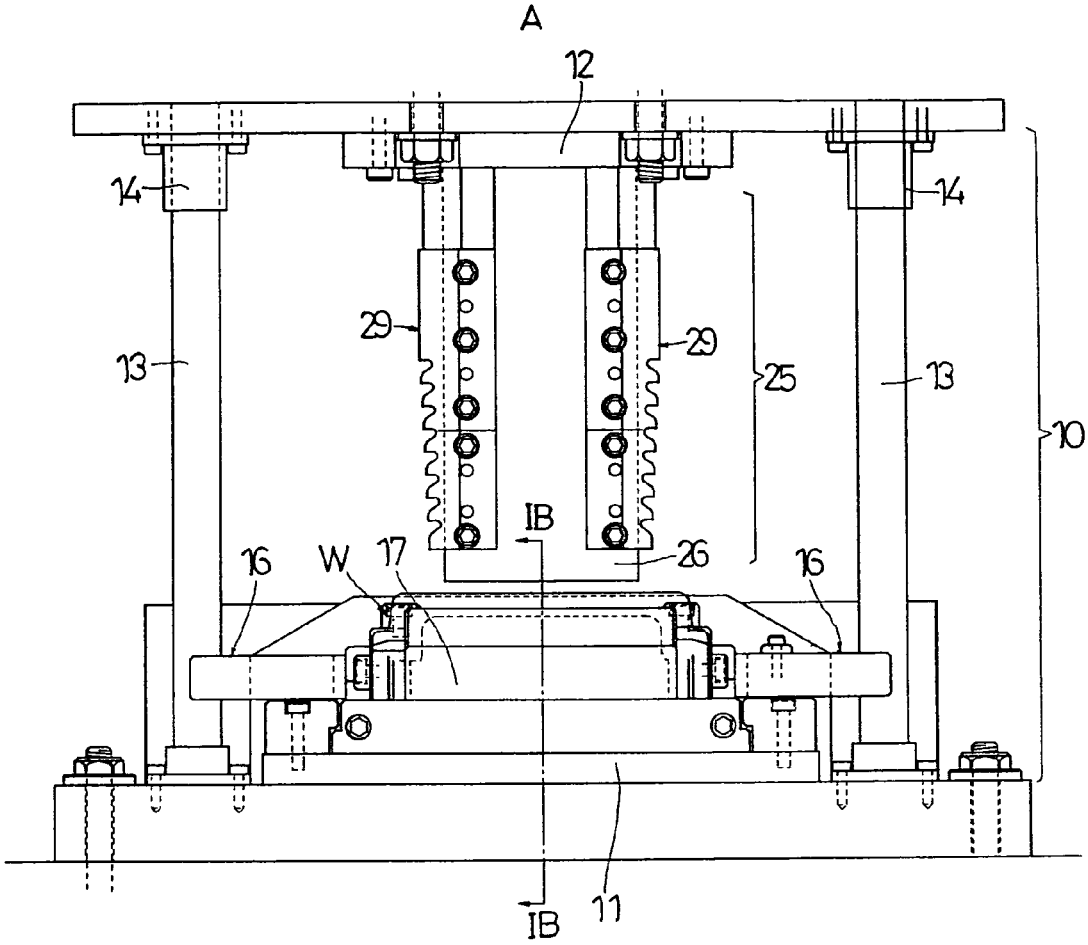
[FIG. 1]
Figure 1:
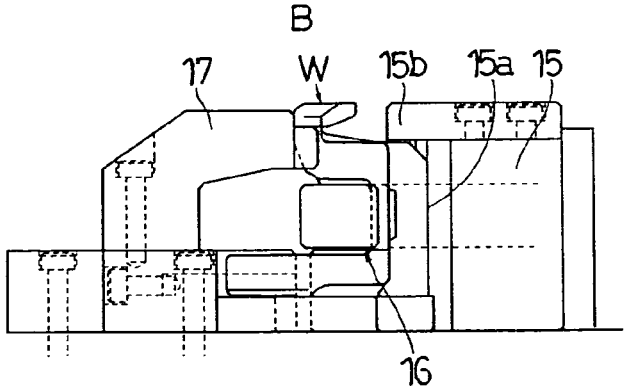

1 Casting
2 Brake pad
4 Brake pad guide
5 Excess metal portion forming brake pad guide
10 Device for removing excess metal from casting
11 Stationary die
12 Movable die
15 Receiving clamp
16 Retracting type clamp
17 Holding clamp
18 Moving body
19 Bearing
21 Cylinder device
22 Expansion portion
23 Guide rod
24 Guide portion
25, 25', 25" Cutter
26 Cutter attaching base plate
27-1 to 27-n Blade
28-1 to 28-(n-1) Interval
29 Cutting blade

BEST MODE FOR CARRYING OUT THE INVENTION

Referring to an embodiment shown in the drawings, the present invention will be explained in more detail.

Structural Constitution

FIG. 1 is a view showing an example of the device 10 for removing excess metal from a casting which is used for executing a method of removing excess metal from a casting with a press according to the present invention. Reference numeral 11 is a stationary die (lower die) located in a lower portion, and reference numeral 12 is a movable die (upper die) located in an upper portion. The movable die 12 is elevated from the stationary die 11 by a necessary stroke being guided by the guide posts 13, 13 mounted on the stationary die 11. Reference numerals 14, 14 are guide bushes provided on the movable die side. Work W, which is a casting, is set on the lower die by the receiving clamp 15 located in the middle of the lower die, the right and left retracting type clamps 16, 16 and the holding clamp 17 located on the viewer's side in the drawing.

As can be seen in FIGS. 7 to 10, the retracting clamps 16, 16 can be opened and closed to the right and left being linked with the moving body 18 which is provided on the lower die and moves backward and forward. The moving body 18 has a bearing 19 which is directed forward, and the rear end portion 16*b* of the retracting clamp 16 is pivotally supported by the support shaft 16*c* at the portion of the bearing 19. In the retracting clamp 16, the cam groove 16*d* having components of the longitudinal direction and the right and left direction is symmetrically provided in the right and the left direction. By the engagement of the cam groove 16*d* with the cam pin 16*e* attached to the lower die side, the opening and closing end portions 16*a* of both clamps are opened when the moving body 18 proceeds, and the opening and closing end portions 16*a* of both clamps are closed when the moving body 18 retreats.

The expansion portion 22 of the cylinder device 21 is attached to the moving body 18. The guide rods 23, 23 extending forward are attached to the moving body 18. On the guide rods 23, 23, the receiving clamp 15 is provided being capable of sliding by the right and left guide portions 24, 24. Further, at the forward end portions of the rods 23, 23, the holding clamp 17 described before is attached. In this connection, the receiving clamp 15 includes: a reference face 15*a* which becomes a reference when a work is set; and upper holding portions 15*b*, 15*b* which hold an upper portion of work W. Accordingly, in the stationary die 11, by the operation of the cylinder device 21, a portion between the receiving clamp 15 and the holding clamp 17 can be opened and closed when the work is set in the device. The retracting type clamps 16, 16 are opened and closed being linked with the opening and closing motion conducted between the receiving clamp 15 and the holding clamp 17. Therefore, a portion of work W is held and strongly fixed.

Figure 2:
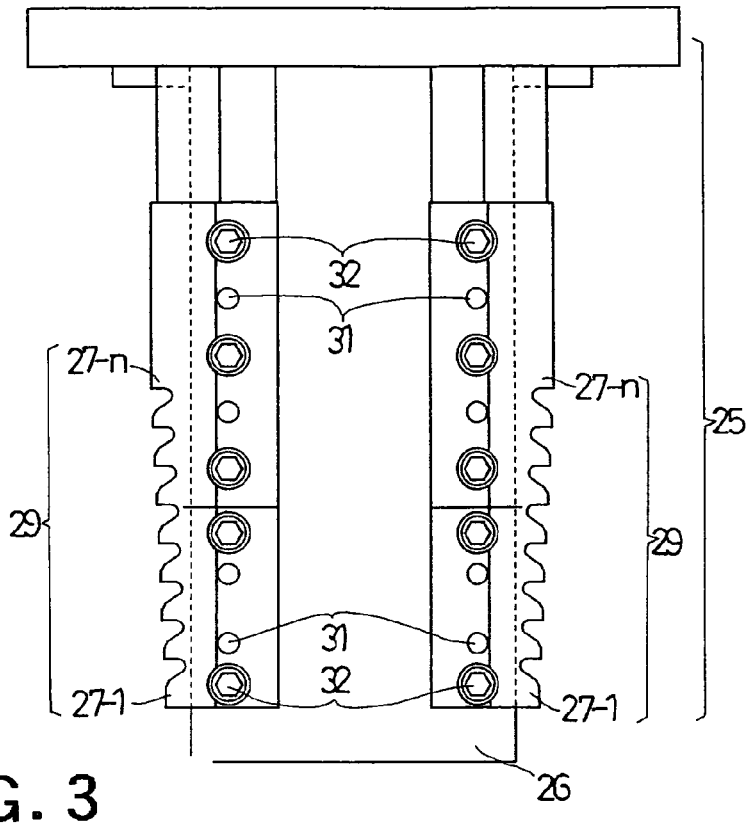
[FIG. 2]
Figure 3:
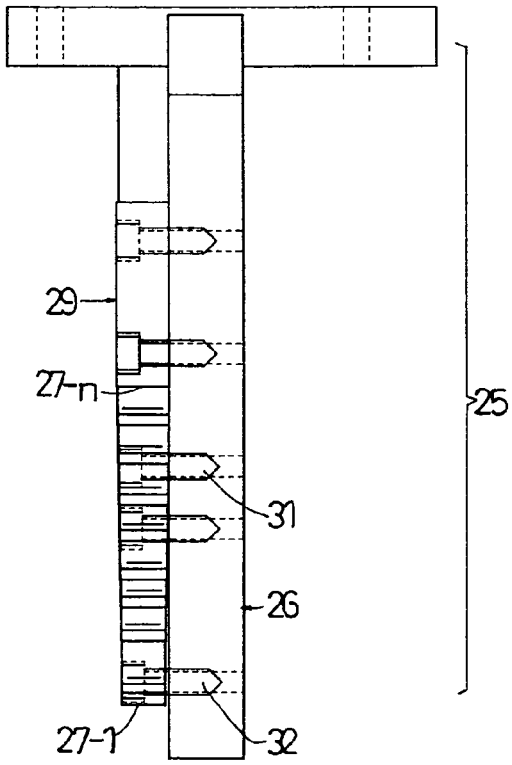
[FIG. 3]
Figure 4:
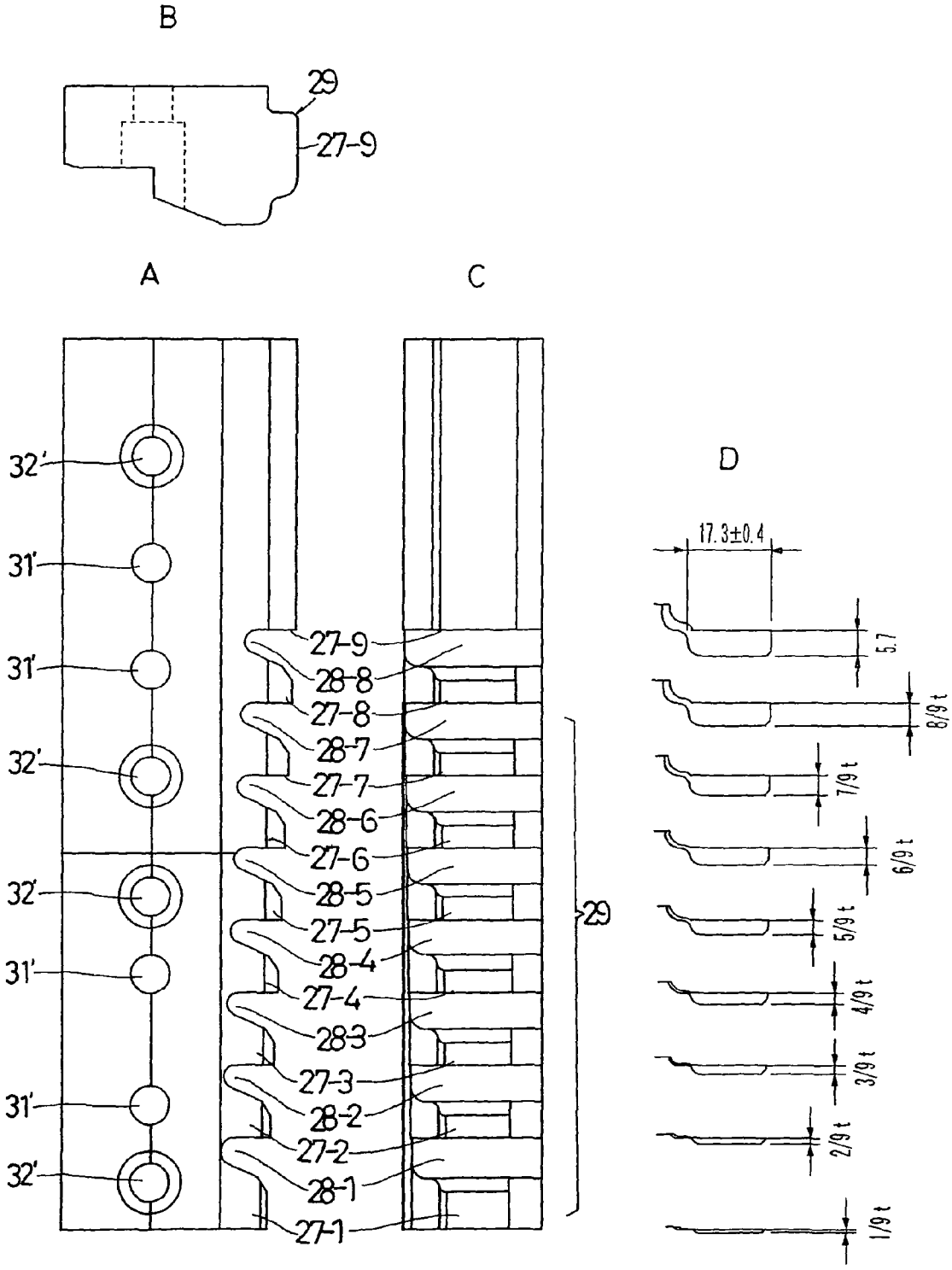
[FIG. 4]

On the other hand, on the movable die 12 side, the cutter 25 is arranged. The exemplary cutter 25 is composed of a cutting blade 29 which is attached onto the cutter attaching base plate 26 which is attached to the lower portion of the movable die 12 being hung, and this cutting blade 29 is a cutting means divided into right, left, upper and lower portions. The cutter 29 comprises: a row of blades in which a plurality of blades 27-1 to 27-n are arranged step-wise in the order of the size having a change in the form from the first blade 27-1, which is smaller than the final shape of the excess metal to be punched, to the final blade 27-n, the shape of which is the same as the final shape, wherein the row of blades from the first blade to the final blade are arranged so that the first small blade 27-1 can be used being ahead of other blades and the first blade 27-1 to the final blade 27-n are arranged in the punching motion direction at appropriate intervals 28-1 to 28-(n-1). Refer to FIGS. 2, 3 and 4.

An example of the form of each blade 27-1, . . . is specifically shown in FIG. 4. The number of steps from the first blade to the final blade 27-n was nine (n=9), and the size of the protruding final blade 27-9 was set in such a manner that the protrusion from the reference face was 5.7 mm and the width was 17.3 mm. This size is the same as the shape of the excess metal to be punched. In this case, the cutting in the depth direction per one blade is 0.63 mm. As shown in FIG. 4, this cutter 25 conducts cutting by 1/9 of the final depth for each blade in each step. Concerning the width, the width of the first blade 27-1 is the smallest, and the width is gradually increased when it comes close to the final blade 27-9. Therefore, the cutting blade 29, which is composed of a row of the blade 27-1, . . . which are arranged in the order of the size, is formed into a step-wise tapered shape directed toward the forward end portion. Concerning the cutting depth, it may not be equal to each other in each step but the cutting depth may be changed for the initial step, the intermediate step and the latter step.

Figure 5:
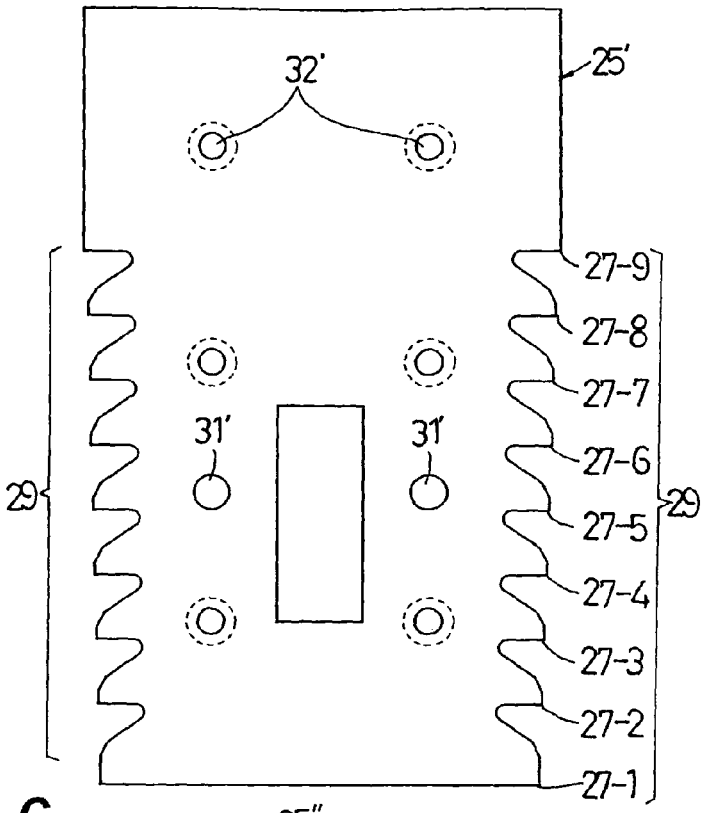
[FIG. 5]
Figure 6:
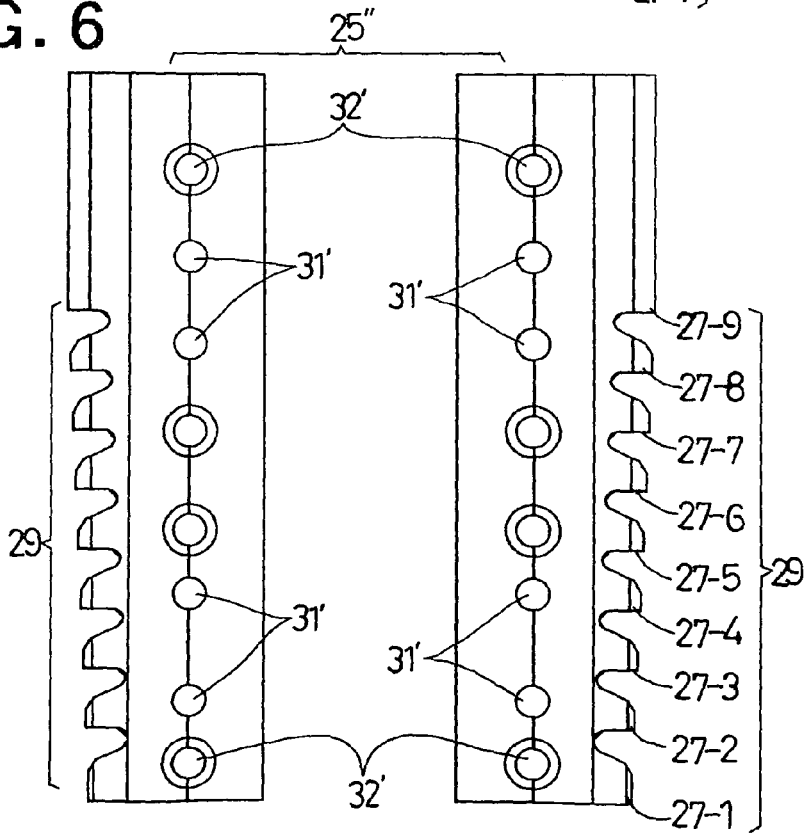
[FIG. 6]
Figure 7:
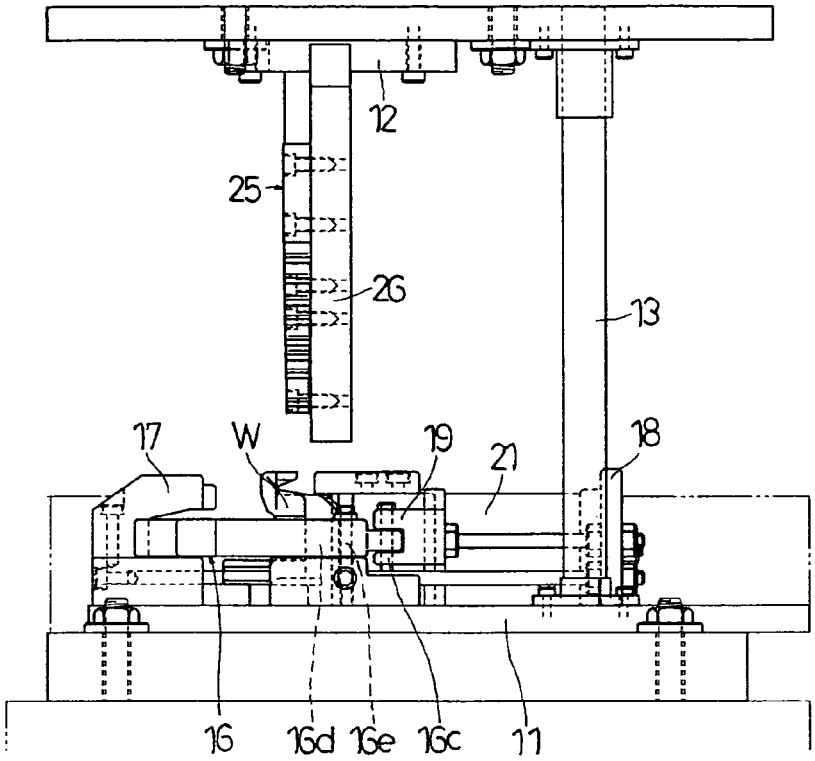
[FIG. 7]
Figure 8:
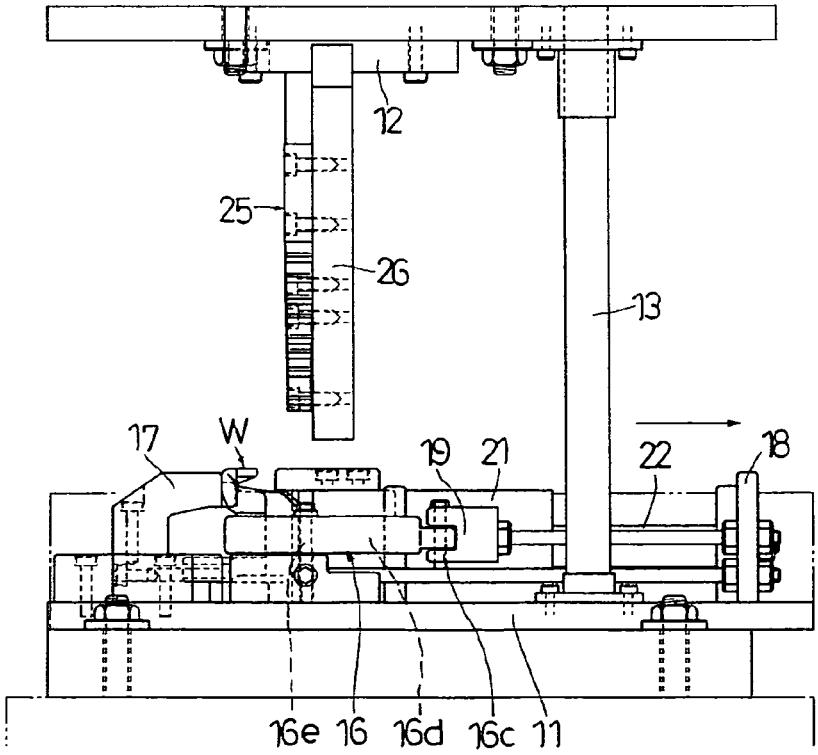
[FIG. 8]
Figure 9:
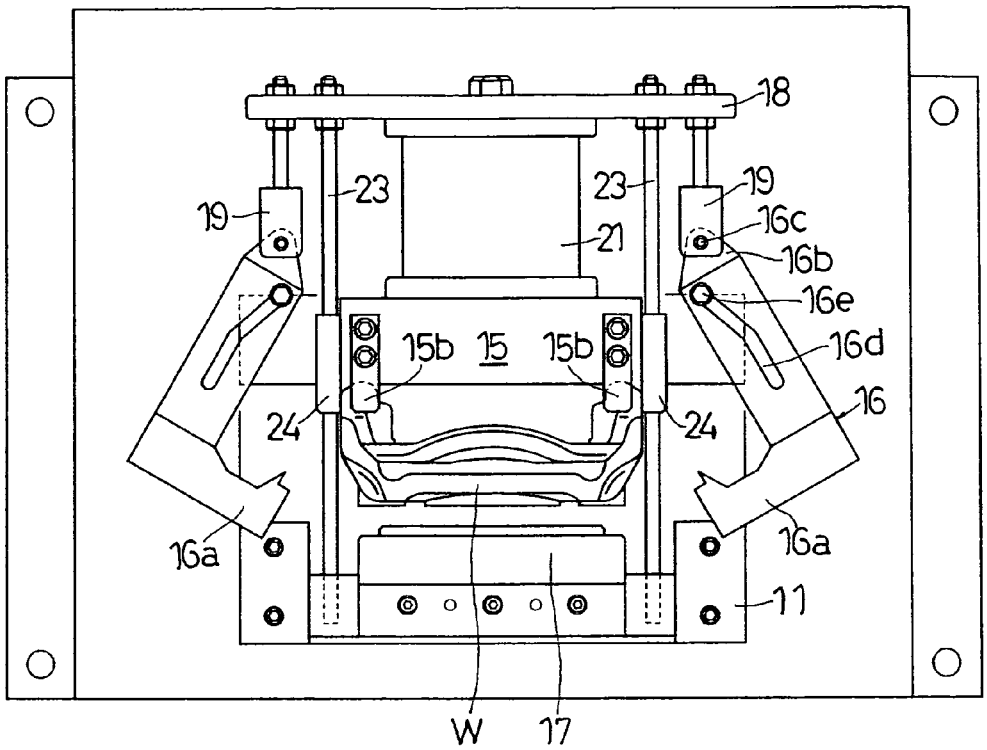
[FIG. 9]
Figure 10:
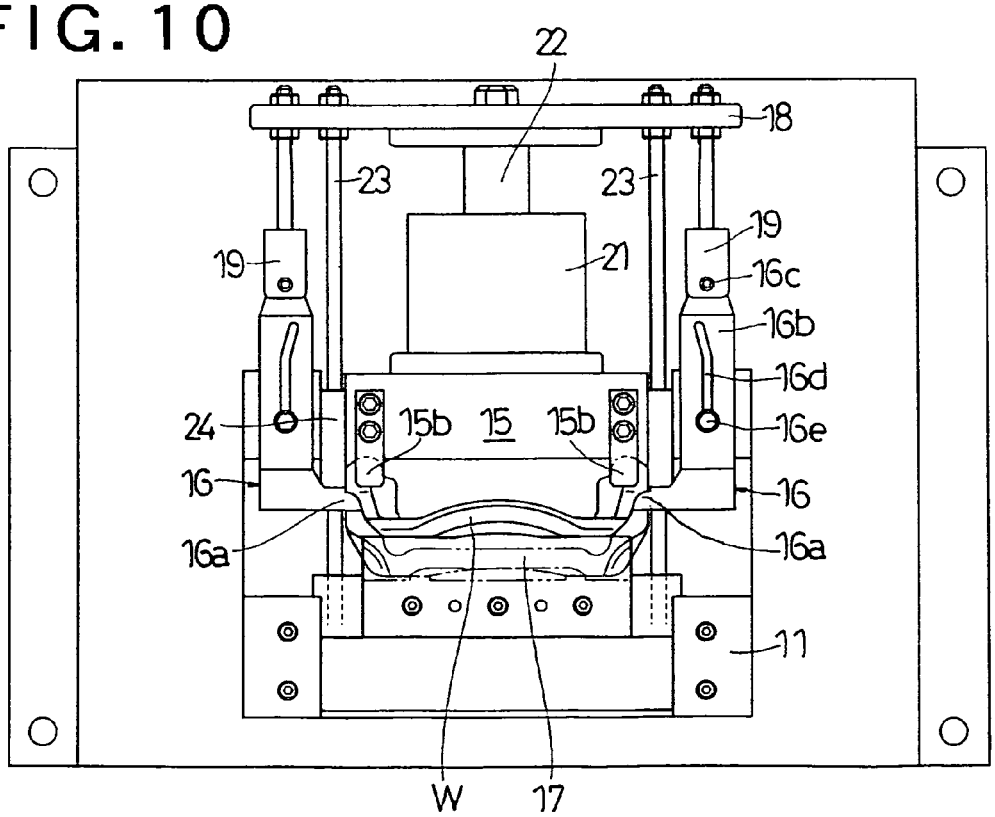
[FIG. 10]
Figure 11:
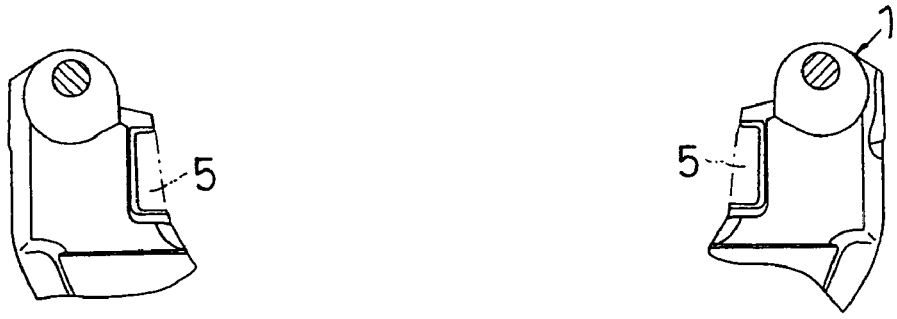
[FIG. 11]
Figure 12:
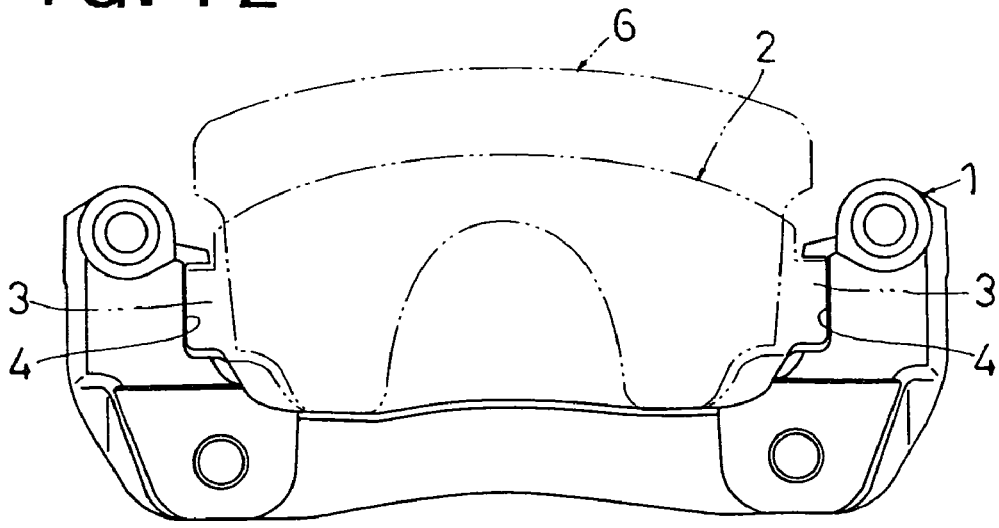
[FIG. 12]

The cutter 25, which is used for the structural constitution of the present invention represented by FIG. 1, is shown as a four-division type cutter which is divided into right, left, upper and lower parts. However, as it has already been referred, this cutter 25 is only an example, and other examples are shown in FIGS. 5 and 6. In the example shown in FIG. 5, the cutter 25', in which the right and the left blade row are integrated with each other into one body, is shown. In the example shown in FIG. 6, the cutter 25", in which the blade row is divided into the right and the left row, is shown. In the examples shown in FIGS. 5 and 6, the number of the blade 27-1, is the same, so that both the integration type and the division type can employ the cutters 25, 25', 25". When any of the cutters 25, 25', 25" is employed, it can be used in such a manner that the cutter is attached to the cutter attaching base plate 26. In this connection, reference numeral 31 is a pin for positioning the cutter by the pins 31 in pin holes or openings 31', and reference numeral 32 is a bolt for attaching the cutter by the bolts 32 in bolt holes or openings 32'.

Invention of Method

Next, explanations will be made into a method of removing excess metal from a casting with a press of the present invention having the structural constitution described above. First, the cylinder device 21 of the lower die 11 composing the die-set is operated, and the receiving clamp 15 is retracted so that a portion between the receiving clamp 15 and the holding clamp 17 can be opened. Then, the retracting type clamps 16, 16 are withdrawn to the right and left (shown in FIGS. 7 and 9), and work W is set at a predetermined position in a predetermined posture. Next, the cylinder device 21 is operated, and the receiving clamp 15 is made to proceed and work W is clamped between the receiving clamp 15 and the holding clamp 17. At the same time, the retracting type clamps 16, 16 are closed, so that work W can be strongly fixed (shown in FIGS. 8 and 10).

After that, the following process is started. The punching motion of the movable die 12 is conducted on the stationary die 11, that is, the excess metal portion 5 of work W is punched into a recess shape and removed. When the movable die 12 starts descending, the first blade 27-1 of the cutter 25, which is attached to the movable die 12, approaches the excess metal portion 5 and conducts cutting by the depth corresponding to 1/n (n=9 in the exemplary case) per one blade (shown in the lowermost portion in FIG. 4D). According to the progress of descending of the movable die 12, the second and the third blade 27-2, 27-3, . . . successively conduct cutting by the depth corresponding to 1/n. In this way, cutting is conducted by the cutting blade in the order of the smaller blade to the larger protruding final blade 27-9. Therefore, when the movable die 12 has once completed the punching operation, the excess metal portion 5 can be perfectly punched to the final recess shape (shown in the uppermost portion in FIG. 4D).

An investigation is made into the punching and removing operation of work W with the press shown in the drawing. In the punching operation, a heavy load is given to the movable die 12 which conducts a punching motion on the lower die of the stationary die 11. According to the present invention, the entire cutting depth of the cutter 25, which conducts the cutting operation, is divided into nine steps or a plurality of steps except for the nine steps, and the cutting depth per one step is determined to be ⅑ or a value obtained when 1 is divided by the number of the plurality of steps. Therefore, a load given to one blade can be remarkably reduced, and even the excess metal portion, the shape of which is a recess shape, can be punched by one stroke punching motion of the movable die 12. After the punching process of punching the excess metal portion into a recess shape has been completed, the movable die 12 is raised and the receiving clamp 15 is retracted, and further the retracting type clamps 16, 16 are opened to the right and left. Then, work W, on which punching has already been conducted, is detached from the device. Further, the next work W is set in the device and the same excess metal removing method is repeatedly conducted on the next work W.

According to the method, device and cutter of the present invention, the degree of freedom for working a casting can be enhanced. Further, since the excess metal can be removed while leaving an appropriate allowance necessary for finishing work, the finishing work can be easily performed. Therefore, according to the present invention, it is possible to excellently conduct the working of the C-shaped recess portion of the disk brake pad guide explained before. Of course, it is possible to conduct the working of an L-shaped (hook-shaped) recess portion and a U-shaped recess portion.

INDUSTRIAL APPLICABILITY

The present invention can be applied to not only the above case, in which working is conducted by the movable die on the stationary die in one direction of the vertical direction, but also a case in which working is conducted by the movable die on the stationary die in three directions of the longitudinal direction, the traverse direction and the vertical direction (the directions of X, Y and Z axes).

The invention claimed is:

1. A cutter for removing excess metal from a casting with a press, said cutter comprising:

plural rows of cutting blades progressively arranged in a step-wise increasing cutting portion depth size order of equal widths and having a change in form from a first cutting blade, smaller in size than a final shape of the excess metal to be removed, to a final cutting blade, a shape of the final cutting blade being a same shape as the final shape of the excess metal to be removed, the plural rows of cutting blades, from the first cutting blade to the final cutting blade being arranged so that the first cutting blade used is ahead of all other cutting blades and the other cutting blades are used in an order of a single punching motion from the first cutting blade to the final cutting blade, the cutting blades being formed from cutting blades divided into at least two right and left rows and the cutting blades being mounted to a cutter mounting base by bolts and pins so as to be replaceable, a plurality of openings arranged vertically in the cutting blades, said bolts and said pins extending into the openings in the cutting blades and into the cutter mounting base for removably positioning by the pins and removably attaching by the bolts, the cutting blades on the cutter mounting base.

2. The cutter according to claim 1, wherein the bolts and the pins are aligned in a line.

3. The cutter according to claim 2, wherein the pins are arranged between the bolts.

* * * * *